United States Patent [19]

Whelan

[11] 4,253,243

[45] Mar. 3, 1981

[54] PROCESS AND APPARATUS FOR MOISTURE CONDITIONING SEED COTTON AND LIKE MATERIALS

[76] Inventor: Paul L. Whelan, 5708 Marina Dr., Garland, Tex. 75043

[21] Appl. No.: 59,536

[22] Filed: Jul. 23, 1979

[51] Int. Cl.[3] ..... F26B 21/10

[52] U.S. Cl. ..... 34/31; 34/48; 34/89; 19/66 CC; 324/65 R

[58] Field of Search ..... 324/65 R; 73/73, 75; 219/497, 501; 34/46, 48, 88, 89, 43, 31; 19/0.27, 66 CC; 432/37

[56] References Cited

U.S. PATENT DOCUMENTS

| | | | |
|---|---|---|---|
| 3,280,474 | 10/1966 | Van Doorn et al. | 34/31 |
| 3,807,055 | 4/1974 | Kraxberger | 34/16.5 |
| 4,143,471 | 3/1979 | Wochnowski et al. | 34/46 |
| 4,170,073 | 10/1979 | Ignatowicz | 34/48 |

*Primary Examiner*—Larry I. Schwartz

*Attorney, Agent, or Firm*—Wofford, Fails & Zobal

[57] ABSTRACT

An improvement in method and apparatus for drying seed cotton to a predetermined range of moisture content; including the steps and means for performing the steps of passing the cotton in contact with a first moisture sensor, subsequently passing the cotton through a drying system, subsequently passing the cotton into contact with a second moisture sensor located outside of the drying system, and using the combination of signals from the sensors to control the amount of moisture removed from the cotton while in the drying system; characterized by employing a plurality of the first moisture sensors so connected that the moisture sensors sensing the least moisture content will have its signal used in the combination of signals to control the amount of moisture removed. This compensates for a problem in the prior art of having a moist leaf or the like cause excessive drying of the seed cotton because of the high moisture contents sensed.

6 Claims, 4 Drawing Figures

PROCESS AND APPARATUS FOR MOISTURE CONDITIONING SEED COTTON AND LIKE MATERIALS

BACKGROUND OF THE INVENTION

1. Field of the Invention

This invention relates to process and apparatus for drying seed cotton and like materials so that the cotton passing through the apparatus contains moisture within a predetermined range of moisture content. More particularly, this invention relates to process and apparatus for drying seed cotton in a cotton gin plant.

2. Description of the Prior Art

In processing seed cotton in a gin plant, it has been practice to dry the cotton to an optimum moisture content before ginning so that the ginning is most efficiently performed. In addition, it is conventional to clean the cotton of foreign matter before stripping the fiber from the seeds. Proper drying is important to preserve staple length. On the other hand, insufficient drying makes more difficult subsequent operations such as cleaning and sometimes causes reduction in the value of the ginned cotton. Ordinarily, the cotton may have a moisture content of from 8% (percent) to 18% or more, whereas the optimum moisture content is in the range of 3%–10%; for example, about 5%.

As noted in prior U.S. Patents such as U.S. Pat. No. 3,114,613, there has been a prior practice of experienced operators inspecting the cotton in its delivered condition and estimating the amount of heat that had to be supplied for drying. This estimation, corrected with periodic inspections, required an extremely capable operator and then was not scientific and less than perfect. As described in U.S. Pat. Nos. 3,114,613, and 3,280,474, an improvement was made where the moisture content was measured scientifically through measuring resistance of the incoming cotton and this signal then employed, alone or with an additional signal coming from the moisture sensing means in the effluent cotton, to control the amount of heat added to dry the cotton to the optimum moisture content in the effluent cotton.

Other patents such as U.S. Pat. Nos. 3,277,581, and 3,364,587, used different approaches for drying materials such as yarn or cotton. Earlier patents such as U.S. Pat. Nos. 2,968,874 and 3,370,360, had apparatus for analyzing either moisture content or the temperature control for drying. Of these patents the most pertinent ones appeared to be U.S. Pat. Nos. 3,114,613, and 3,280,474 employing resistance measuring as indicative of the moisture content of the cotton. These patents have the disadvantage, however, that a single moist leaf or the like in the incoming cotton is reflected by an erroneously high moisture content that caused excessive heat to be imparted to the system. This upsets the control system and causes excessive drying or excessive hunting on the controls.

SUMMARY OF THE INVENTION

Accordingly, it is an objective of this invention to provide method and apparatus that alleviates the deficiencies of the prior art and provides economical, readily employable apparatus for accurately drying the cotton to a predetermined moisture content.

It is a specific object of this invention to provide a method and apparatus that enables drying seed cotton to a predetermined moisture content while alleviating the difficulties of the prior art with spurious, high moisture indicating signals that effected overheating.

These and other objects of this invention will become apparent from the descriptive matter later hereinafter, particularly when taken in conjunction with the appended drawings.

In accordance with one aspect of this invention, there is provided an improvement in the process of drying seed cotton to a desired moisture content, the process including the steps of:

a. passing the cotton into operative relationship with a first moisture sensing means,
b. subsequently passing the cotton through a drying system, and
c. utilizing the signals obtained from the first moisture sensing means to effect control of the amount of moisture removed from the cotton while in the drying process;

the improvement comprising employing a plurality of first moisture sensing means so connected that the moisture sensing means measuring the greatest resistance, or lowest moisture content, will be sensed and used to control the amount of moisture removed from the cotton. Preferably in this aspect, the process also passes the cotton into operative relationship with a second moisture sensing means located downstream of the drying system so as to sense the moisture in the effluent cotton and the signals from the first and second moisture sensing means are combined to maintain better automatic control of the moisture removed.

In another aspect of this invention, there is provided an improvement in apparatus for drying seed cotton to a desired range of moisture content, the apparatus including:

a. means to pass the cotton through a hot air drying system,
b. a first moisture sensing means located in position to sense the moisture content of the cotton prior to entering the drying system, and
c. means to regulate the amount of heat supplied to the drying system at least partially responsive to the signal from the first moisture sensing means;

the improvement comprising employing a plurality of first moisture sensing means so connected that the moisture sensing means that is measuring the least moisture content will be sensed and utilized by the means to regulate the amount of heat supplied. In the preferred embodiment of this aspect, the apparatus also includes:

d. a second moisture sensing means located in position to sense the moisture content of the cotton after it is passed through the drying system,
e. means to modify the signal obtained from the first moisture sensing means by the signal obtained from the second moisture sensing means and
f. means to regulate the amount of heat supplied to the drying system in accordance with the modified signal so obtained, the signal that is employed from the first moisture sensing means being that sensing the least moisture content; ordinarily, the greatest resistance for an electrical current.

DESCRIPTION OF THE PREFERRED EMBODIMENTS

Figure 1:
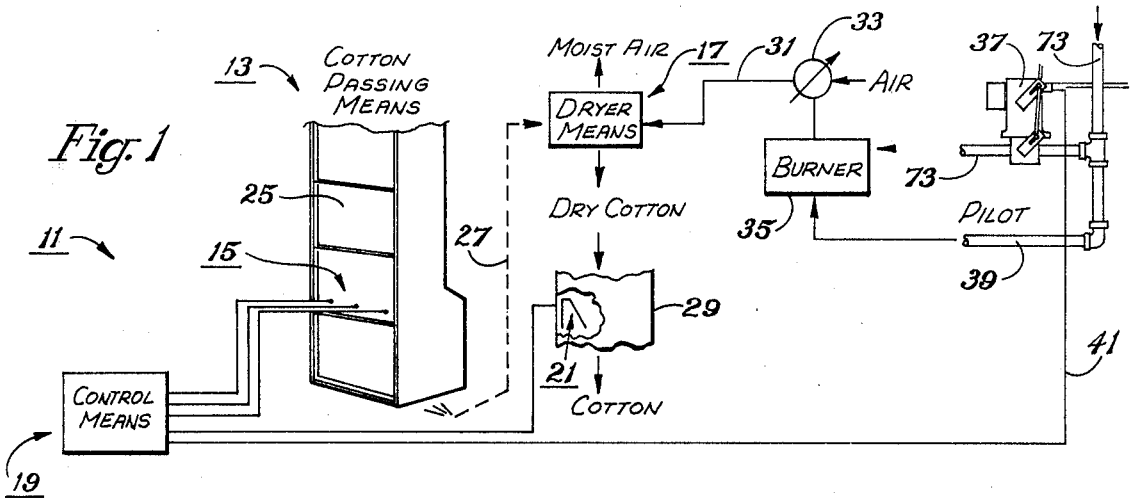
FIG. 1 is a schematic illustration of the improved system in accordance with one embodiment of this invention.

Referring to FIG. 1, the apparatus 11 in accordance with one embodiment of this invention includes the cotton passing means 13 for feeding and passing the cotton through a hot air drying system, a plurality of first moisture sensing means 15, dryer means 17 drying the cotton, and control means 19 for employing the signal from the first moisture sensing means in regulating the amount of heat supplied to the dryer means 17. As indicated hereinbefore, the apparatus 11 also includes second moisture sensing means 21 and, in the control means, means to modify the signal obtained from the first moisture sensing means by the signal obtained from the second moisture sensing means in order to more finely regulate the amount of heat supplied to the dryer means 17.

The cotton passing means 13 is conventional and may take a wide variety of forms. For example, the cotton passing means may be in the form of the apparatus of U.S. Pat. No. 3,114,613 or in the form of U.S. Pat. No. 3,280,474 in order to pass the cotton through the drying system. Referring to the apparatus of U.S. Pat. No. 3,114,613, the cotton passing means 13 includes the conduits such as incoming hopper 25. Conventionally, seed cotton is transported pneumatically. A separator separates the cotton for control feed unit therebelow from the moving air. Typically the control feed unit has a receiving chamber through which the cotton moves by gravity and feed means such as vaned rollers that control the rate of introduction of the cotton to the dryer. Feed rollers pass the cotton to the dryer at a rate commensurate with the capacity of the gin plant and the cotton awaiting entry to the dryer accumulates in a substantially uniform mass in a collecting chamber or duct. As indicated hereinafter in more detail, the first moisture sensing means is placed in the incoming hopper 25 for sensing the moisture of the incoming cotton. As indicated by the dash line 27, the cotton passes on to the dryer means 17 and, thence, in feeder chute 29 to a gin stand or the like. It is at this point downstream of the dryer means 17 that the second moisture sensing means 21 are located.

The dryer means 17 may comprise any of the conventional forms. Typically, it contains a revolving cylinder and the seed cotton travels through the dryer responsive to the rotation of spiral baffles acting as a large screw type conveyor. The surface of the cylinder is formed with a mesh or grid that allows hot air from the manifold to blow through and across the cylinder to dry the seed cotton as it tumbles within the cylinder. An imperforate housing of the dryer serves as a thermal jacket to confine the hot air within the dryer. Any foreign material within the seed cotton falls through the apertures in the surface of the cylinder and comes to rest within the bottom of the housing from whence it is conveniently collected and removed. This type construction is conventional, although it may be varied, need not be described in detail herein, since these dryers are commercial items that are readily bought and installed.

A conduit is provided for supplying hot air to the dryer means, the conduit means being indicated by line 31. The air is heated in heat exchanger 33. The heat is supplied to heat exchanger 33 from burner 35 having fuel supplied via motor valve 37 on the main fuel line 73. A pilot line 39 maintains flame for ignition of fuel such as natural gas. The conventional safety controls are provided to keep from having flame sweep through the cotton plant, an explosion or the like. The gas feed motor valve 37 controls the rate of which gas is supplied for combustion in the burner; and, thus, ultimately the temperature provided for drying the cotton by way of conduit 31. The valve 37 may be controlled by any sort of motor, such as pneumatically activated motor, electrically activated motor or the like. The motor is, in turn, connected, as shown by line 41 with the control means 19 so as to control the amount of gas supplied to the burner 35 responsive to the signal from the control means 19.

Frequently, major combined assemblies of the dryer are available commercially and can be readily bought and installed.

It is at the point of measuring the moisture of the incoming cotton, or the first moisture sensing means 15, that this invention makes its major contribution. Specifically, for years the moisture measuring means has been sensed by measuring electrical resistance and inferring the moisture contents from the resistance measurement. This is described in U.S. Pat. No. 3,114,613; although in that patent a ram was used to compress the fiber against the resistance measuring elements. In any event, in an ordinary system, the electrical resistance is measured across the cotton, either to another element of the resistance electrode or to grounded walls. As long as the fiber of the cotton is the only element in the path closing the electrical circuit, this technique is accurate to within about 1% or less of the moisture of the incoming cotton.

A serious problem with this measurement, however, is that a single green leaf or stem will bridge the gap between the electrodes. Since the stem has a larger moisture content than the cotton fiber, in all likelihood, the sensor will "see" a higher moisture content. Consequently, the burner supplies a greater amount of heat to the air and overdries the cotton.

In accordance with this invention, a plurality of respective sensors are employed as first moisture sensing means and are connected such that only the sensor reading the lowest moisture content will be employed in the control means 19.

Figure 2:
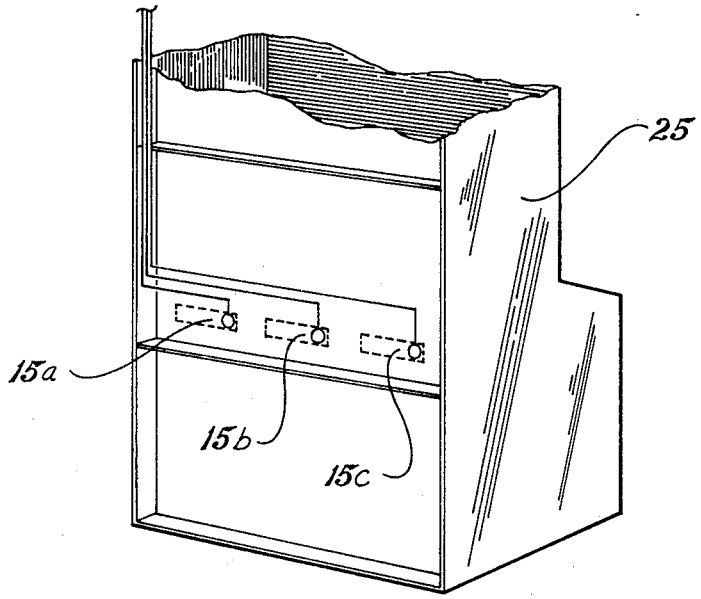
FIG. 2 is a partial isometric view showing the location of the plurality of first moisture sensing means in the hopper to measure the moisture content of the incoming cotton.
Figure 3:
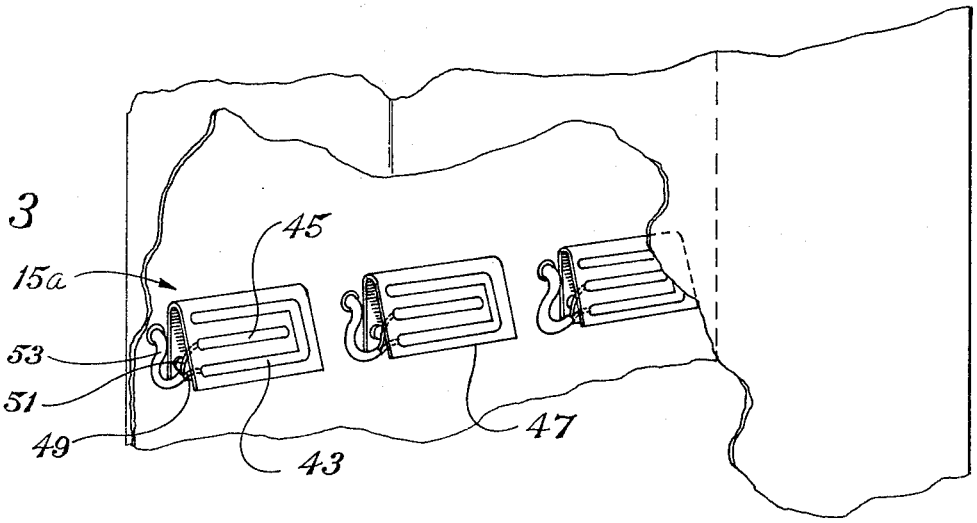
FIG. 3 is an isometric view of a typical sensor installation in accordance with the embodiment of FIG. 2.

This can be seen in FIGS. 2 and 3. Therein, the cotton passes down the incoming hopper 25 past the first moisture sensing means 15*a–c*. As can be seen in more detail in FIG. 3, each of the first moisture sensing means 15*a–c* include a first electrode 43 and a second electrode 45 on a cantilevered inclined shelf 47 that protrudes into the path of the cotton. Suitable electrical conductors 49, 51 are then connected by way of conductor cable 53 with the control means 19. With this structure, it is unnecessary to compress the cotton with a separate ram to measure the moisture content.

The more sensors that are employed in the first moisture sensing means, the greater percentage of the time the network output signal will represent the true moisture of the incoming cotton fiber. It has been found, however, that three such first moisture sensing means 15*a–c* are adequate to give excellent control in accordance with this invention.

Figure 4:
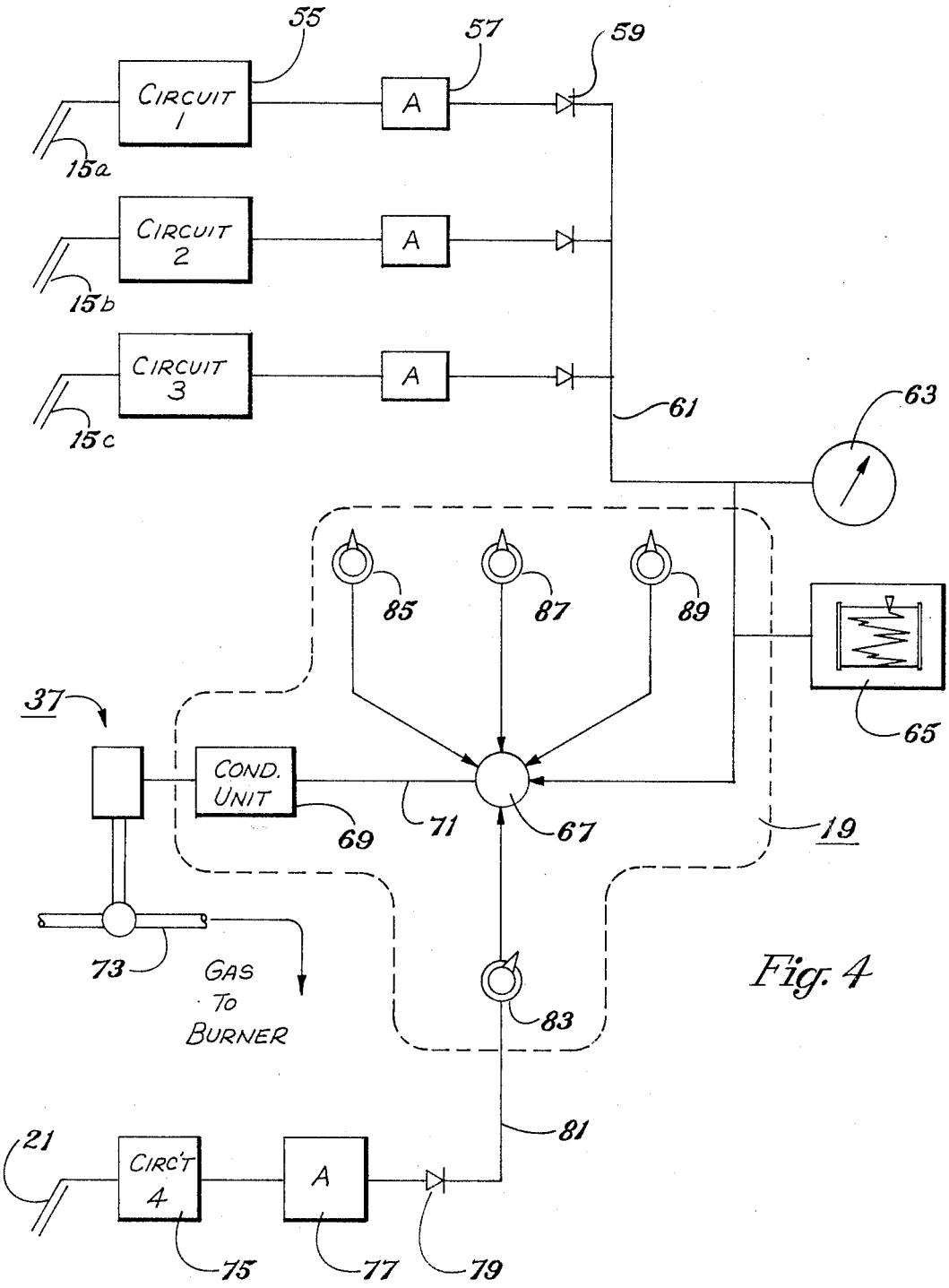
FIG. 4 is a schematic view of the instrumentation of the embodiment of FIG. 1.

The schematic of the control circuit is illustrated in FIG. 4. Therein, the respective first moisture sensing means 15*a–c* are each serially connected into respective circuits 55, amplifiers 57 and diodes 59. Each of the circuits 55 may comprise any of the means for measuring and inverting electrical resistivity such that the output signal is in the form of an output voltage that is inversely porportional to the moisture of incoming cotton, or directionally porportional to the resistance measured. Any of the circuits that are readily designable by electrical engineers could be employed to effect this result. For example, the circuit of FIG. 4 of U.S. Pat. No. 3,114,613 produced an output signal that was directly proportional to the moisture content, or inversely proportional to the resistance and could be connected into an inverting amplifier for the circuits 55 if desired. It has been found in this invention, that a typical signal might comprise ten volts (10 v.) for a maximum dry condition of about 8% moisture in the incoming cotton and changed to about 0.3 volts representing the maximum wet, or about 18% moisture in the incoming cotton. The respective signals are then fed to the respective amplifiers 57 and the diodes 59. Since the diodes 59 are biased into inoperable conditions and pass current in only one direction, the greater voltage on the first moisture sensing means sensing the least moisture will cause a biasing on the other diodes such that only the first sensing means indicating the least moisture is sent by way of the conductor 61 to the control means 19. As indicated, a meter 63 shows visually the moisture content. The conductor 61 is also connected to a recorder 65 that records the moisture content.

A modifying means 67 is connected with the conductor 61 for modifying the signal from the first moisture sensing means to the signal conditioning unit (COND. UNIT) 69. The modifying means may be a summing network that sums up a plurality of inputs as will be described in more detail. The conditioning unit 69 converts the output signal from the modifying means 67, on conduit 71, to an equivalent voltage for positioning the motor valve 37 at a predetermined position for supplying gas by way of the main burner conduit 73 to the gas burner.

As indicated hereinbefore, the second sensing means 21 is also connected into the control means 19. Specifically, the second moisture sensing means 21 is serially connected with circuit (CIRC'T) 75, amplifier 77 and diode 79. The output of diode 79 is connected by conductor 81 with a rheostat 83 sets the "authority" of the second moisture sensing means. By that, is meant the degree the signal from the second moisture means will affect the signal from the first moisture sensing means in the modifying means 67. The circuit 75 is the same circuit as circuits 55 described hereinbefore with respect to the first moisture sensing means. Similarly, the amplifier 77 is the same as the amplifier 57 and the diode 79 is the same as the diode 59 so as to produce compatible output signals.

Additional rheostats 85, 87 and 89 are also employed for fine tuning the control circuits in the control means 19. Specifically, the rheostat 87 sets the moisture level at which the motor valve 37 starts to open. The rheostat 87 sets the valve range, or sensitivity. The rheostat 89 allows the operator to control whether the cotton is to be dried more or less for effecting the desired separation of the fibers from the seeds in the downstream ginning operation.

The motor valve 37 may operate as any of the conventional motor valves, as indicated hereinbefore. For example, the controls may be a control unit such as the fuel miser available from Cliff Granberry Corporation, Dallas, Tex. in conjunction with conventional motor valves such as the Barber Colman AE 53, which is a servo motor incorporating a reversible motor with a potentiometer or slide wire mounted on the output shaft. As will be apparent to one skilled in this art, suitable transistor relays provide a link between the control unit, indicating unit and the controlled device, such as the servo motor. A change in position of a potentiometer in the indicator unit causes an unbalance in the bridge circuit to the servo motor potentiometer. This unbalance is detected by the transistor relay which makes a contact causing the motor in the power unit to rotate in the proper direction to rebalance the circuit. As the details of the commercially available items employed in this invention are well known, the precise circuity is not shown in the drawings or described in greater detail herein.

In operation, the operator may have some trial runs to calibrate the unit. Thus, if a signal from the first moisture sensing means 15*a–c* indicates that the moisture content has a moisture content of about 10%, the indicator unit, servo mechanism circuit will balance itself by rotation of the shaft to the position to give a midpoint reading on the motor valve 37. If, on the other hand the first moisture sensing means indicates a moisture reading of about 18%, the necessary circuit rebalancing will place the gas valve in the full open position for maximum firing of the burner. Conversely, if a moisture content below about 8%, the control circuits will effect closure of the motor valve 37. Within these limits, the intermediate positions of the valve will be controlled by the moisture of the cotton. The system is flexible and can be adjusted through adjusting the respective rheostats 83–89 for trouble free and easy operation in all aspects of the ginning of the cotton.

As indicated hereinbefore, the first moisture sensing means, alone, may be employed to control the heat added to the system in drying the cotton. It has been found, however, that better results are obtained when both the first and second moisture sensing means are employed for controlling the heat added since better control is achieved through a combination of the signals from the moisture of the incoming cotton and the moisture of the dried cotton.

From the foregoing, it can be seen that this invention accomplishes the objects delineated hereinbefore.

Although the invention has been described with a certain degree of particularity, it is understood that the present disclosure is made only by way of example and that numerous changes in the details of construction and the combination and arrangement of parts may be resorted to without departing from the spirit and the scope of the invention, reference for the latter being had to the appended claims.

What is claimed is:

1. In a process of drying seed cotton to a desired range of moisture content which includes the steps of:

a. passing the cotton along a treatment path and into operative relationship with a first moisture sensing means, b. subsequently passing the cotton through a drying system, c. subsequently passing the cotton into operative relationship with a second moisture sensing means located outside of the drying system, and d. utilizing a combination of signals obtained from the sensing means set forth in a and c above to control the amount of moisture removed from the cotton while in the drying system;

the improvement comprising:

e. employing a plurality of said first moisture sensing means disposed at different respective locations across said treatment path so as to sense the moisture content of said cotton at said plurality of locations; said plurality of first moisture sensing means being connected in discrete, parallel circuits and so connected that only the first moisture sensing means measuring an indication of least moisture content will be employed as a control signal, and f. utilizing the signal from only the first moisture sensing means measuring the least moisture content in combination with the signal from the second moisture sensing means to control the amount of moisture removed from the cotton.

2. The process of claim 1 wherein three first moisture sensing means are employed.

3. The process in the process of claim 1 wherein said three first moisture sensing means are connected with respective circuits affording an output voltage that varies inversely with moisture content, said circuits being connected in parallel with respective diodes such that the greatest voltage output signals biases the remaining diodes to prevent conduction of other lesser signals.

4. An apparatus for processing seed cotton to a predetermined range of moisture content that includes:

a. means to pass the cotton along a treatment path and through a hot air drying system, b. a first moisture sensing means for sensing the moisture of the incoming cotton, said first moisture sensing means being disposed so as to contact the cotton prior to its entering the drying system, c. a second moisture sensing means located in a position to sense the moisture content of the cotton after it has passed through the drying system, d. means to modify the signal obtained from the first moisture sensing means by the signal obtained from the second moisture sensing means, e. means for regulating the amount of heat supplied to the drying system in accordance with the modified signal obtained in (d) above;

the improvement comprising:

f. a plurality of first moisture sensing means disposed at different respective locations across said treatment path so as to sense the moisture content of said cotton at said plurality of locations; said plurality of first moisture sensing means being connected in discrete, parallel circuits and so connected that only the first moisture sensing means measuring the least moisture content will provide a control signal, and g. the modifying means of (d) so connected as to modify the signal from the first moisture sensing means measuring the least moisture content and connected with the means for regulating the amount of heat supplied to the drying system in accordance with the modified signal contained in (f).

5. The apparatus of claim 4 wherein said plurality of first moisture sensing means comprises three moisture sensing means.

6. The apparatus of claim 5 wherein said at least three moisture sensing means are connected with respective circuits affording an output voltage that varies inversely with moisture content, said circuits being connected in parallel with the respective diodes, the output of the diodes being connected onto a common conductor that is connected with said means to modify the signal obtained from said first moisture sensing means by the signal obtained from said second moisture sensing means such that the greatest voltage output signal biases the remaining diodes to prevent conduction of other lesser signals.

* * * * *